US008927679B2

(12) United States Patent
Wang et al.

(10) Patent No.: US 8,927,679 B2
(45) Date of Patent: Jan. 6, 2015

(54) TUNING TONER GLOSS WITH BIO-BASED STABILIZERS

(71) Applicant: Xerox Corporation, Norwalk, CT (US)

(72) Inventors: Yulin Wang, Oakville (CA); Ke Zhou, Oakville (CA); Tie Hwee Ng, Mississauga (CA); Edward Graham Zwartz, Mississauga (CA); Cuong Vong, Hamilton (CA); Shigang Qiu, Toronto (CA)

(73) Assignee: Xerox Corporation, Norwalk, CT (US)

( * ) Notice: Subject to any disclaimer, the term of this patent is extended or adjusted under 35 U.S.C. 154(b) by 9 days.

(21) Appl. No.: 13/741,586

(22) Filed: Jan. 15, 2013

(65) Prior Publication Data

US 2014/0199623 A1 Jul. 17, 2014

(51) Int. Cl.
*G03G 9/10* (2006.01)
*G03G 9/08* (2006.01)

(52) U.S. Cl.
CPC ..... *G03G 9/10* (2013.01); *G06G 9/0802* (2013.01); *G03G 9/0819* (2013.01)
USPC ..... 528/196; 430/137.14

(58) Field of Classification Search
CPC . G03G 9/09733; G03G 9/0804; C08G 65/329
USPC ..... 430/137.14; 528/196
See application file for complete search history.

(56) References Cited

U.S. PATENT DOCUMENTS

2005/0255402 A1* 11/2005 Hopper et al. ..... 430/137.14
2008/0187855 A1* 8/2008 Patel et al. ..... 430/109.4
2011/0086301 A1* 4/2011 Cheng et al. ..... 430/105

* cited by examiner

*Primary Examiner* — Mark A Chapman
(74) *Attorney, Agent, or Firm* — MDIP LLC

(57) ABSTRACT

The disclosure describes a process to produce toner with tunable gloss levels comprising a stabilizer to freeze particle growth following aggregation, where the stabilizer does not chelate metal ions.

7 Claims, No Drawings

TUNING TONER GLOSS WITH BIO-BASED STABILIZERS

FIELD

Bio-based stabilizers that freeze growth of aggregating toner particles without chelating metal ions and used to tune gloss levels of the toner; developers comprising said toners; devices comprising said toners and developers; imaging device components comprising said toners and developers; imaging devices comprising said developers; and so on, are described.

BACKGROUND

Gloss control (high, low and matte) of fused images can be accomplished through toner design. Two main approaches are to add a cross-linked gel latex to the toner particle and/or adjusting the amount of chelating agent or adjusting the degree of cross-linking by ionic species. However, both approaches have limitations, such as, when making a low gloss toner or a low melt toner. For example, if the amount of chelating agent is reduced to retain more aluminum cations within the particle, controlling particle size and particle size distribution is difficult. Also, chelators sometimes are used to control pH when ending the aggregation process. The dual action of such chelators can confound toner properties in the absence of fine control of chelator amount and timing of use, if possible.

Therefore, there remains a need to manufacture low gloss toners, low melt toners or both without stressing particle design or production.

SUMMARY

The instant disclosure describes a toner process where a bio-based stabilizer is used to freeze particle aggregation. The stabilizer is not a chelator of, for example, metal ions. Suitable stabilizers include polyols and polyhydroxylated organic acids and acid salts, such as, glucosic acid and derivatives thereof, such as, glucono-δ-lactone, sodium gluconate, calcium gluconate and potassium gluconate. In embodiments, the toner is a low melt toner. In embodiments, the toner is a low gloss toner. Gloss can be tuned using other reagents, such as, a chelator, a gel or both.

DETAILED DESCRIPTION

In emulsion/aggregation processes for making toner, the aggregation step can be terminated, for example, by increasing pH. Often that is achieved by using a base or a buffer, for example. It is not uncommon for buffers to contain a chelator, which not only can serve as a buffering agent to maintain pH but also to bind ions, which can influence pH as well. A common chelator is EDTA and hence, EDTA is used commonly as pH generally is raised to halt particle growth. As it also is known that retained aluminum ion can influence toner gloss and EDTA can bind aluminum ion, EDTA impacts toner gloss.

However, using one reagent to perform two functions can interject limitations on obtaining suitable end points for those two functions.

The gloss of a toner may be influenced by the amount of retained metal ion, such as, $Al^{3+}$, in a toner particle. The more metal ion retained in the particle, the lower the gloss of the toner. If the goal is to produce a low gloss toner, a low melt toner or both, the present disclosure unexpectedly improves on previous methods which either require addition of cross-linking gel resin which has the undesirable effect of causing increase in crease fix minimum fusing temperature (MFT) or to require that the chelating agent be decreased to amounts that cause difficulty in controlling particle development and particle population quality. A low gloss toner of interest is one which produces images on a standard paper having gloss of less than about 50 gu, less than about 25 gu, less than about 20 gu.

The present disclosure unexpectedly overcomes those problems by substituting a biodegradable or bio-based stabilizer in place of chemical chelating agents known in the art thereby avoiding the need for a chemical chelating agent, such as, EDTA, during the termination of aggregation. Use of a gel resin is optional, that is, the toner can be free of gel resin or can contain some gel resin. In the present disclosure, the pH of the reaction slurry is adjusted between around 3 and about 9, between about 4 and about 8. The result of the process of interest are particles of desired size with controlled amounts of coarse particles, that is, particles larger than those desired in a population that is uniform, that is, the average geometric standard deviation of the resulting particle population, whether volume or number, is less than about 1.25, less than about 1.24, less than about 1.23 or lower, where coarse particles have a larger size that falls outside of those statistical limits.

In embodiments, the amount of retained metal ion, that is, the bulk ion content, for example, $Al^{3+}$, in toner particles of the present disclosure may be at least about 100 ppm, at least about 200 ppm, at least about 250 ppm (parts per million), as determined, for example, by inductively coupled plasma mass spectrometry (ICP MS). A toner of the instant disclosure may have a gloss, as measured by Gardner gloss units (gu), of from about 10 gu to about 50 gu, from about 10 gu to about 40 gu, from about 10 gu to about 30 gu.

The stabilizers of interest enable terminating aggregation without impacting toner gloss resulting in suitably sized particles of tight distribution. Gloss can be controlled using known methods, such as, introducing a chelator, adjusting the nature and amount of aggregating agent, using a gel latex and so on, and combinations thereof, as known in the art. In that way, the gloss can be tuned without impacting particle population size and distribution.

Unless otherwise indicated, all numbers expressing quantities and conditions, and so forth used in the specification and claims are to be understood as being modified in all instances by the term, "about." "About," is meant to indicate a variation of no more than 20% from the stated value. Also used herein is the term, "equivalent," "similar," "essentially," "substantially," "approximating" and "matching," or grammatic variations thereof, have generally acceptable definitions or at the least, are understood to have the same meaning as, "about."

As used herein, "hyperpigmented," means a toner having higher pigment loading at low toner mass per unit area (TMA) such as to provide a sufficient image reflection optical density of greater than about 1.4 when printed and fused on a substrate, such as, a paper, such pigment loading chosen so that the ratio of TMA measured for a single color layer in $mg/cm^2$ divided by the volume diameter of the toner particle in microns, is less than about 0.075, to meet that required image density.

As used herein, "low melt," when used to describe a toner is one which may comprise crystalline resin, a wax with a lower melting point or both. A low melt toner is one with a lower melting point during fixing than conventional toner. Hence, a low melt toner may have a fixing temperature or MFT less than about 125° C., less than about 120° C., less than about 115° C., less than about 110° C. or lower.

As used herein, "pH adjuster" means an acid or base or buffer which may be used to change the pH of a composition (e.g., slurry, resin, aggregate, toner, and the like). Such adjusters may include, but are not limited to, sodium hydroxide (NaOH), nitric acid, sodium acetate/acetic acid, and the like.

As used herein, a, "bio-based," molecule is one which originates from a biological source, such as, a plant, an animal or a microbe, although the molecule may be made in vitro. Such molecules generally are biodegradable. A bio-based molecule is in distinction from a, "chemical," molecule which is one which is artificially synthesized and does not originate in a living organism. A chemical may be biologically compatible, that is, can be ingested or placed in a biologic or living entity without substantial adverse impact. However, degradation of that chemical in vivo can be slow, nonexistent or the chemical is converted to another chemical species that can have a deleterious effect on the biologic or living entity, or in the environment. Generally, a bio-based compound of interest is one which is biodegradable, that is, changes from the original state to another by, spontaneous chemical reaction, biologic action and the like, which occurs, in minutes, days, hours, weeks and so on, but generally, not longer than one year.

As used herein, "in the absence of," and equivalent phrases thereof is meant to mean that a compound or method does not contain or require a reagent or step. Hence, that phrase also is interpreted to mean, "not needed," "does not contain," and so on, to positively recite a negative condition.

I. Toner Particles

Toner particles of interest can comprise a polyacrylate, a polystyrene, a polyester resin and so on, as known in the art. Thus, a resin-forming monomer can be reacted with suitable other reactants to form a polymer resin.

Examples of suitable resins or polymers which may be utilized in forming a toner include, but are not limited to, poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly (styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly (styrene-butyl acrylate-acrylonitrile-acrylic acid), and combinations thereof.

A toner composition can comprise more than one form or sort of polymer, such as, two or more different polymers, such as, two or more different polyester polymers composed of different monomers. The polymer can be an alternating copolymer, a block copolymer, a graft copolymer, a branched copolymer, a crosslinked copolymer and so on.

The toner particle can include other optional reagents, such as, a surfactant, a wax, a shell and so on. The toner composition optionally can comprise inert particles, which can serve as toner particle carriers, which can comprise the resin taught herein. The inert particles can be modified, for example, to serve a particular function. Hence, the surface thereof can be derivatized or the particles can be manufactured for a desired purpose, for example, to carry a charge or to possess a magnetic field.

The discussion below is directed to polyester resins, however, the features of the method of interest and the resulting product can be obtained using other resins used to make toner.

A. Components

1. Resin

Toner particles of the instant disclosure include a resin-forming monomer suitable for use in forming a particulate containing or carrying one or more colorants of a toner for use in certain imaging devices. The polyester-forming monomer is one that is inducible to form a resin, that is, which reacts, sets or solidifies to form a solid. Such a resin, a plastic, an elastomer and so on, whether naturally occurring or synthetic, is one that can be used in an imaging device. Generally, any suitable monomer or monomers are induced to polymerize to form a polyester resin or a copolymer. Any polyfunctional monomer may be used depending on the particular polyester polymer desired in a toner particle. Hence, bifunctional reagents, trifunctional reagents and so on can be used. One or more reagents that comprise at least three functional groups are incorporated into a polymer or into a branch to enable branching, further branching and/or crosslinking Examples of such polyfunctional monomers include 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane and 1,2,7,8-octanetetracarboxylic acid. Polyester resins, for example, can be used for applications requiring low melting temperature. Formed particles can be mixed with other reagents, such as, a colorant, to form a developer.

One, two or more polymers may be used in forming a toner or toner particle. In embodiments where two or more polymers are used, the polymers may be in any suitable ratio (e.g., weight ratio) such as, for instance, with two different polymers, from about 1% (first polymer)/99% (second polymer) to about 99% (first polymer)/1% (second polymer), from about 10% (first polymer)/90% (second polymer) to about 90% (first polymer)/10% (second polymer) and so on, as a design choice. For example, a toner can comprise two forms of amorphous polyester resins and a crystalline resin in relative amounts as a design choice.

The polymer may be present in an amount of from about 65 to about 95% by weight, from about 75 to about 85% by weight of toner particles on a solids basis.

a. Polyester Resins

Suitable polyester resins include, for example, those which are sulfonated, non-sulfonated, crystalline, amorphous, combinations thereof and the like. The polyester resins may be linear, branched, crosslinked, combinations thereof and the like. Polyester resins may include those described, for example, in U.S. Pat. Nos. 6,593,049; 6,830,860; 7,754,406; 7,781,138; 7,749,672; and 6,756,176, the disclosure of each of which is incorporated by reference in entirety.

When a mixture is used, such as, amorphous and crystalline polyester resins, the ratio of crystalline polyester resin to amorphous polyester resin can be in the range from about 1:99 to about 50:50; from about 5:95 to about 40:60; in embodiments, from about 5:95 to about 35:65.

A polyester resin may be obtained synthetically, for example, in an esterification reaction involving a reagent comprising a carboxylic acid group and another reagent comprising an alcohol. In embodiments, the alcohol reagent comprises two or more hydroxyl groups, in embodiments, three or more hydroxyl groups. In embodiments, the acid comprises two or more carboxylic acid groups, in embodiments, three or more carboxylic acid groups. Reagents comprising three or more functional groups enable, promote or enable and promote polymer branching and crosslinking. In embodiments, a polymer backbone or a polymer branch comprises at least one monomer unit comprising at least one pendant group or side group, that is, the monomer reactant from which the unit was obtained comprises at least three functional groups.

Examples of polyacids or polyesters that can be used for preparing an amorphous polyester resin include terephthalic acid, phthalic acid, isophthalic acid, fumaric acid, trimellitic acid, diethyl fumarate, dimethyl itaconate, cis-1,4-diacetoxy-2-butene, dimethyl fumarate, diethyl maleate, maleic acid, succinic acid, itaconic acid, succinic acid, cyclohexanoic acid, succinic anhydride, dodecylsuccinic acid, dodecylsuccinic anhydride, glutaric acid, glutaric anhydride, adipic acid, pimelic acid, suberic acid, azelaic acid, dodecanedioic acid, dimethyl naphthalenedicarboxylate, dimethyl terephthalate, diethyl terephthalate, dimethylisophthalate, diethylisophthalate, dimethylphthalate, phthalic anhydride, diethylphthalate, dimethylsuccinate, naphthalene dicarboxylic acid, dimer diacid, dimethylfumarate, dimethylmaleate, dimethylglutarate, dimethyladipate, dimethyl dodecylsuccinate, and combinations thereof. The polyacid or polyester reagent may be present in an amount from about 40 to about 60 mole % of the resin, from about 42 to about 52 mole % of the resin, from about 45 to about 50 mole % of the resin, and optionally a second polyacid can be used in an amount from about 0.1 to about 10 mole % of the resin.

Examples of polyols which may be used in generating an amorphous polyester resin include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene glycol, and combinations thereof. The amount of polyol can vary, and may be present, for example, in an amount from about 40 to about 60 mole % of the resin, from about 42 to about 55 mole % of the resin, from about 45 to about 53 mole % of the resin, and a second polyol, can be used in an amount from about 0.1 to about 10 mole %, from about 1 to about 4 mole % of the resin.

Polycondensation catalysts may be used in forming the amorphous (or crystalline)polyester resin, and include tetraalkyl titanates, dialkyltin oxides, such as, dibutyltin oxide, tetraalkyltins, such as, dibutyltin dilaurate, and dialkyltin oxide hydroxides, such as, butyltin oxide hydroxide, aluminum alkoxides, alkyl zinc, dialkyl zinc, zinc oxide, stannous oxide, or combinations thereof. Such catalysts may be used in amounts of, for example, from about 0.01 mole % to about 5 mole % based on the starting polyacid or polyester reagent(s) and amount(s) thereof used to generate the polyester resin.

In embodiments, the resin may be a crosslinkable or crosslinked resin, also known herein as a gel latex. A crosslinkable resin is a resin including a crosslinkable group or groups such as a C═C bond or a pendant group or side group, such as, a carboxylic acid group. The resin can be crosslinked, for example, through a free radical polymerization with an initiator.

Examples of amorphous resins which may be used include alkali sulfonated-polyester resins, branched alkali sulfonated-polyester resins, alkali sulfonated-polyimide resins and branched alkali sulfonated-polyimide resins. Alkali sulfonated polyester resins may be useful in embodiments, such as, the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(prop ylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly (ethoxylated bisphenol-A-5-sulfo-isophthalate), wherein the alkali metal is, for example, a sodium, a lithium or a potassium ion.

In embodiments, an unsaturated amorphous polyester resin may be used as a latex resin. Examples of such resins include those disclosed in U.S. Pat. No. 6,063,827, the disclosure of which hereby is incorporated by reference in entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), poly(1,2-propylene itaconate) and combinations thereof.

In embodiments, when two amorphous polyester resins are utilized, one of the amorphous polyester resins may be of high molecular weight (HMW) and the second amorphous polyester resin may be of low molecular weight (LMW).

As used herein, an HMW amorphous resin may have, for example, a weight average molecular weight ($M_w$) greater than about 55,000, for example, from about 55,000 to about 150,000, from about 50,000 to about 100,000, from about 60,000 to about 95,000, from about 70,000 to about 85,000, as determined by gel permeation chromatography (GPC), using polystyrene standards.

An HMW amorphous polyester resin may have an acid value of from about 8 to about 20 mg KOH/grams, from about 9 to about 16 mg KOH/grams, from about 11 to about 15 mg KOH/grams. HMW amorphous polyester resins, which are available from a number of commercial sources, can possess various melting points of, for example, from about 30° C. to about 140° C., from about 75° C. to about 130° C., from about 100° C. to about 125° C., from about 115° C. to about 121° C.

An LMW amorphous polyester resin has, for example, an $M_w$, of 50,000 or less, from about 2,000 to about 50,000, from about 3,000 to about 40,000, from about 10,000 to about 30,000, from about 15,000 to about 25,000, as determined by GPC using polystyrene standards. The LMW amorphous polyester resins, available from commercial sources, may have an acid value of from about 8 to about 20 mg KOH/grams, from about 9 to about 16 mg KOH/grams, from about 10 to about 14 mg KOH/grams. The LMW amorphous resins can possess an onset $T_g$ of from about 40° C. to about 80° C., from about 50° C. to about 70° C., from about 58° C. to about 62° C., as measured by, for example, differential scanning calorimetry (DSC).

For forming a crystalline polyester resin, suitable organic polyols include aliphatic polyols with from about 2 to about 36 carbon atoms, such as 1,2-ethanediol, 1,3-propanediol, 1,4-butanediol, 1,5-pentanediol, 2,2-dimethylpropane-1,3-diol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like, including their structural isomers. The aliphatic polyol may be, for example, selected in an amount from about 40 to about 60 mole %, from about 42 to about 55 mole %, from about 45 to about 53 mole %, and a second polyol, can be used in an amount from about 0.1 to about 10 mole %, from about 1 to about 4 mole % of the resin.

Examples of polyacid or polyester reagents for preparing a crystalline resin include oxalic acid, succinic acid, glutaric acid, adipic acid, suberic acid, azelaic acid, sebacic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid (sometimes referred to herein, in embodiments, as cyclohexanedioic acid), malonic acid and mesaconic acid, a polyester or anhydride thereof; and an alkali sulfo-organic polyacid, such as, the sodio, lithio or potassio salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfo-p-hydroxybenzoic acid, N,N-bis(2-hydroxyethyl)-2-amino ethane sulfonate, or mixtures thereof. The polyacid may be selected in an amount of from about 40 to about 60 mole %, from about 42 to about 52 mole %, from about 45 to about 50 mole %, and optionally, a second polyacid can be selected in an amount from about 0.1 to about 10 mole % of the resin.

Specific crystalline resins include poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), copoly(2,2-dimethylpropane-1,3-diol-decanoate)-copoly(ethylene-adipate), alkali copoly(5-sulfoisophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfoisophthaloyl)-copoly(ethylene-succinate), alkali copoly(5-sulfoisophthaloyl)-copoly(propylene-succinate), alkali copoly(5-sulfoisophthaloyl)-copoly(butylenes-succinate), alkali copoly(5-sulfoisophthaloyl)-copoly(pentylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipatenonylene-decanoate), poly(octylene-adipate), and so on, wherein alkali is a metal like sodium, lithium or potassium. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide), and poly(butylene-succinimide).

Suitable crystalline resins which may be utilized, optionally in combination with an amorphous resin as described above, include those disclosed in U.S. Pub. No. 2006/0222991, the disclosure of which is hereby incorporated by reference in entirety.

In embodiments, a suitable crystalline resin may include a resin formed of a mixture of dodecanedioic acid and fumaric acid co-monomers, and ethylene glycol.

The crystalline resin may be present in an amount from about 1 to about 85% by weight of the toner components, from about 2 to about 50% by weight of the toner components, from about 5 to about 35% by weight of the toner components. The crystalline resin can possess various melting points of from about 30° C. to about 120° C., from about 50° C. to about 90° C., from about 60° C. to about 80° C. The crystalline resin may have a number average molecular weight ($M_n$), as measured by GPC of from about 1,000 to about 50,000, from about 2,000 to about 25,000, and an $M_w$ of from about 2,000 to about 100,000, from about 3,000 to about 80,000, as determined by GPC using polystyrene standards. The molecular weight distribution ($M_w/M_n$) of the crystalline resin may be from about 2 to about 6, from about 3 to about 4.

b. Catalyst

Condensation catalysts may be used in the polyester reaction and include tetraalkyl titanates; dialkyltin oxides, such as, dibutyltin oxide; tetraalkyltins, such as, dibutyltin dilaurate; dibutyltin diacetate; dibutyltin oxide; dialkyltin oxide hydroxides, such as, butyltin oxide hydroxide; aluminum alkoxides, alkyl zinc, dialkyl zinc, zinc oxide, stannous oxide, stannous chloride, butylstannoic acid, or combinations thereof.

Such catalysts may be used in amounts of, for example, from about 0.01 mole % to about 5 mole % based on the amount of starting polyacid, polyol or polyester reagent in the reaction mixture.

Generally, as known in the art, the polyacid/polyester and polyols reagents, are mixed together, optionally with a catalyst, and incubated at an elevated temperature, such as, from about 180° C. or more, from about 190° C. or more, from about 200° C. or more, and so on, which can be conducted anaerobically, to enable esterification to occur until equilibrium, which generally yields water or an alcohol, such as, methanol, arising from forming the ester bonds in esterification reactions. The reaction can be conducted under vacuum to promote polymerization.

Branching agents can be used, and include, for example, a multivalent polyacid, such as, 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl) methane, 1,2,7,8-octanetetracarboxylic acid, acid anhydrides thereof, lower alkyl esters thereof and so on. The branching agent can be used in an amount from about 0.01 to about 10 mole % of the resin, from about 0.05 to about 8 mole % or from about 0.1 to about 5 mole % of the resin.

It may be desirable to crosslink the polymer to form a gel latex, and presence of gel latex can reduce gloss. A suitable resin conducive to crosslinking is one with a reactive group, such as, a C═C bond or with pendant or side groups, such as, a carboxylic acid group. The resin can be crosslinked, for example, through free radical polymerization with an initiator.

Suitable initiators include peroxides, such as, organic peroxides or azo compounds, for example, diacyl peroxides, such as, decanoyl peroxide, lauroyl peroxide and benzoyl peroxide, ketone peroxides, such as, cyclohexanone peroxide and methyl ethyl ketone, alkyl peroxy esters, such as, t-butyl peroxy neodecanoate, 2,5-dimethyl 2,5-di(2-ethyl hexanoyl peroxy)hexane, t-amyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, alkyl peroxides, such as, dicumyl peroxide, 2,5-dimethyl 2,5-di(t-butyl peroxy)hexane, t-butyl cumyl peroxide, bis(t-butyl peroxy)diisopropyl benzene, di-t-butyl peroxide and 2,5-dimethyl 2,5-di(t-butyl peroxy)hexyne-3, alkyl hydroperoxides, such as, 2,5-dihydro peroxy 2,5-dimethyl hexane, cumene hydroperoxide, t-butyl hydroperoxide and t-amyl hydroperoxide, and alkyl peroxyketals, such as, n-butyl 4,4-di(t-butyl peroxy)valerate, 1,1-di(t-butyl peroxy) 3,3,5-trimethyl cyclohexane, 1,1-di(t-butyl peroxy)cyclohexane, 1,1-di (t-amyl peroxy)cyclohexane, 2,2-di(t-butyl peroxy)butane, ethyl 3,3-di(t-butyl peroxy)butyrate and ethyl 3,3-di(t-amyl peroxy)butyrate, azobis-isobutyronitrile, 2,2'-azobis(isobutyronitrile), 2,2'-azobis(2,4-dimethyl valeronitrile), 2,2'-azobis(methyl butyronitrile), 1,1'-azobis(cyano cyclohexane), 1,1-di(t-butyl peroxy)-3,3,5-trimethylcyclohexane, combinations thereof and the like. The amount of initiator used can be proportional to the degree of crosslinking, and thus, the gel content of the polyester material. The amount of initiator used may range from about 0.01 to about 10 weight %, from about 0.1 to about 5 weight % of the polyester resin. In the crosslinking, it can be desirable that substantially all of the initiator be consumed. The crosslinking may be carried out at high temperature, and thus the reaction may be very fast, less than 10 minutes, from about 20 seconds to about 2 minutes residence time.

Hence, disclosed herein is a polyester resin suitable for use in imaging which can comprise a mixture of the relevant reagents prior to polymerization, such as, a polyacid/polyester reagent, and a polyol reagent whether polymerized or not. In embodiments, a polyester resin is produced and processed to form a polymer reagent, which can be dried and formed into flowable particles, such as, a pellet, a powder and the like. The polymer reagent then can be incorporated with, for example, other reagents suitable for making a toner particle, such as, a colorant and/or a wax, and processed in a known manner to produce toner particles.

Polyester resins can carry one or more properties, such as, a $T_g$(onset) of at least about 40° C., at least about 45° C., at least about 55° C.; a $T_s$ of at least about 100° C., at least about 105° C., at least about 115° C.; an acid value (AV) of at least about 5, at least about 7, at least about 10; and an $M_w$ of at least about 5000, at least about 15,000, at least about 100,000.

2. Colorants

Suitable colorants include those comprising carbon black, such as, REGAL 330® and Nipex 35; magnetites, such as, Mobay magnetites, MO8029™ and MO8060™; Columbian magnetites, MAPICO® BLACK; surface-treated magnetites; Pfizer magnetites, CB4799™, CB5300™, CB5600™ and MCX6369™; Bayer magnetites, BAYFERROX 8600™ and 8610™; Northern Pigments magnetites, NP-604™ and NP-608™; Magnox magnetites, TMB-100™ or TMB-104™ and the like.

Colored pigments, such as, cyan, magenta, yellow, red, orange, green, brown, blue or mixtures thereof can be used. The additional pigment or pigments can be used as water-based pigment dispersions.

Examples of pigments include SUNSPERSE 6000, FLEXIVERSE and AQUATONE, water-based pigment dispersions from SUN Chemicals; HELIOGEN BLUE L6900™, D6840™, D7080™, D7020™, PYLAM OIL BLUE™, PYLAM OIL YELLOW™ and PIGMENT BLUE I™ available from Paul Uhlich & Company, Inc.; PIGMENT VIOLET I™, PIGMENT RED 48™, LEMON CHROME YELLOW DCC lO26™, TOLUIDINE RED™ and BON RED C™ available from Dominion Color Corporation, Ltd., Toronto, Ontario; NOVAPERM YELLOW FGL™ and HOSTAPERM PINK E™ from Hoechst; CINQUASIA MAGENTA™ available from E.I. DuPont de Nemours & Co., and the like.

Examples of magenta pigments include 2,9-dimethyl-substituted quinacridone, an anthraquinone dye identified in the Color Index as CI 60710, CI Dispersed Red 15, a diazo dye identified in the Color Index as CI 26050, CI Solvent Red 19 and the like.

Examples of cyan pigments include copper tetra(octadecylsulfonamido) phthalocyanine, a copper phthalocyanine pigment listed in the Color Index as CI 74160, CI Pigment Blue, Pigment Blue 15:3, Pigment Blue 15:4, an Anthrazine Blue identified in the Color Index as CI 69810, Special Blue X-2137 and the like.

Examples of yellow pigments are diarylide yellow 3,3-dichlorobenzidene acetoacetanilide, a monoazo pigment identified in the Color Index as CI 12700, CI Solvent Yellow 16, a nitrophenyl amine sulfonamide identified in the Color Index as Foron Yellow SE/GLN, CI Disperse Yellow 3, 2,5-dimethoxy-4-sulfonanilide phenylazo-4'-chloro-2,5-dimethoxy acetoacetanilide and Permanent Yellow FGL.

Other known colorants can be used, such as, Levanyl Black A-SF (Miles, Bayer) and Sunsperse Carbon Black LHD 9303 (Sun Chemicals), and colored dyes, such as, Neopen Blue (BASF), Sudan Blue OS (BASF), PV Fast Blue B2G 01 (American Hoechst), Sunsperse Blue BHD 6000 (Sun Chemicals), Irgalite Blue BCA (CibaGeigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), SUCD-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing and the like. Other pigments that can be used, and which are commercially available include various pigments in the color classes, Pigment Yellow 74, Pigment Yellow 14, Pigment Yellow 83, Pigment Orange 34, Pigment Red 238, Pigment Red 122, Pigment Red 48:1, Pigment Red 269, Pigment Red 53:1, Pigment Red 57:1, Pigment Red 83:1, Pigment Violet 23, Pigment Green 7 and so on, and combinations thereof.

The colorant, for example carbon black, cyan, magenta and/or yellow colorant, may be incorporated in an amount sufficient to impart the desired color to the toner. In general, pigment or dye, may be employed in an amount ranging from about 2% to about 35% by weight of the toner particles on a solids basis, from about 5% to about 25%, from about 5% to about 15% by weight.

In embodiments, more than one colorant may be present in a toner particle. For example, two colorants may be present in a toner particle, such as, a first colorant of pigment blue, may be present in an amount ranging from about 2% to about 10% by weight of the toner particle on a solids basis, from about 3% to about 8% by weight, from about 5% to about 10% by weight; with a second colorant of pigment yellow that may be present in an amount ranging from about 5% to about 20% by weight of the toner particle on a solids basis, from about 6% to about 15% by weight, from about 10% to about 20% by weight and so on.

3. Optional Components a. Surfactants

Toner compositions may be in dispersions including surfactants. Emulsion aggregation methods where the polymer and other components of the toner are in combination can employ one or more surfactants to form an emulsion.

One, two or more surfactants may be used. The surfactants may be selected from ionic surfactants and nonionic surfactants, or combinations thereof. Anionic surfactants and cationic surfactants are encompassed by the term, "ionic surfactants."

The surfactant or the total amount of surfactants may be used in an amount of from about 0.01% to about 5% by weight of the toner-forming composition, from about 0.75% to about 4%, from about 1% to about 3% by weight of the toner-forming composition.

Examples of nonionic surfactants include, for example, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether and dialkylphenoxy poly(ethyleneoxy) ethanol, for example, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC® PR/F, in embodiments, SYNPERONIC® PR/F 108; and a DOWFAX, available from The Dow Chemical Corp.

Anionic surfactants include sulfates and sulfonates, such as, sodium dodecylsulfate (SDS), sodium dodecylbenzene sulfonate, sodium dodecylnaphthalene sulfate and so on; dialkyl benzenealkyl sulfates; acids, such as, palmitic acid, and NEOGEN or NEOGEN SC obtained from Daiichi Kogyo Seiyaku, and so on, combinations thereof and the like. Other suitable anionic surfactants include, in embodiments, alkyldiphenyloxide disulfonates or TAYCA POWER BN2060 from Tayca Corporation (Japan), which is a branched sodium dodecyl benzene sulfonate. Combinations of those surfactants and any of the foregoing nonionic surfactants may be used in embodiments.

Examples of cationic surfactants include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, trimethyl ammonium bromides, halide salts of quarternized polyoxyethylalkylamines, dodecylbenzyl triethyl ammonium chlorides, MlRAPOL® and ALKAQUAT® available from Alkaril Chemical Company, SANISOL® (benzalkonium chloride) available from Kao Chemicals and the like, and mixtures thereof, including, for example, a nonionic surfactant as known in the art or provided hereinabove.

b. Waxes

The toners of the instant disclosure, optionally, may contain a wax, which can be either a single type of wax or a mixture of two or more different types of waxes (hereinafter identified as, "a wax"). A wax can be added to a toner formulation or to a developer formulation, for example, to improve particular toner properties, such as, toner particle shape, charging, fusing characteristics, gloss, stripping, offset properties and the like. Alternatively, a combination of waxes can be added to provide multiple properties to a toner or a developer composition. A wax may be included as, for example, a fuser roll release agent.

The wax may be combined with the resin-forming composition for forming toner particles. When included, the wax may be present in an amount of from about 1 wt % to about 25 wt % of the toner particles, from about 5 wt % to about 20 wt % of the toner particles.

Waxes that may be selected include waxes having, for example, an $M_w$ of from about 500 to about 20,000, from about 1,000 to about 10,000. Waxes that may be used include, for example, polyolefins, such as, polyethylene, polypropylene and polybutene waxes, such as, those that are commercially available, for example, POLYWAX™ polyethylene waxes from Baker Petrolite, wax emulsions available from Michaelman, Inc. or Daniels Products Co., EPOLENE N15™ which is commercially available from Eastman Chemical Products, Inc., VISCOL 550-P™, a low weight average molecular weight polypropylene available from Sanyo Kasei K.K.; plant-based waxes, such as carnauba wax, rice wax, candelilla wax, sumac wax and jojoba oil; animal-based waxes, such as beeswax; mineral-based waxes and petroleum-based waxes, such as montan wax, ozokerite, ceresin wax, paraffin wax, microcrystalline wax and Fischer-Tropsch waxes; ester waxes obtained from higher fatty acids and higher alcohols, such as stearyl stearate and behenyl behenate; ester waxes obtained from higher fatty acids and monovalent or multivalent lower alcohols, such as butyl stearate, propyl oleate, glyceride monostearate, glyceride distearate and pentaerythritol tetrabehenate; ester waxes obtained from higher fatty acids and multivalent alcohol multimers, such as diethyleneglycol monostearate, dipropyleneglycol distearate, diglyceryl distearate and triglyceryl tetrastearate; sorbitan higher fatty acid ester waxes, such as sorbitan monostearate; cholesterol higher fatty acid ester waxes, such as, cholesteryl stearate, and so on.

Examples of functionalized waxes that may be used include, for example, amines and amides, for example, AQUA SUPERSLIP 6550™ and SUPERSLIP 6530™ available from Micro Powder Inc.; fluorinated waxes, for example, POLYFLUO 190™, POLYFLUO 200™, POLYSILK 19™ and POLYSILK 14™ available from Micro Powder Inc.; mixed fluorinated amide waxes, for example, MICROSPERSION 19™ also available from Micro Powder Inc.; imides, esters, quaternary amines, carboxylic acids, acrylic polymer emulsions, for example, JONCRYL 74™, 89™, 130™, 537™ and 538™ available from SC Johnson Wax; and chlorinated polypropylenes and polyethylenes available from Allied Chemical, Petrolite Corp. and SC Johnson. Mixtures and combinations of the foregoing waxes also may be used in embodiments.

For low melt applications, a wax can be selected that has a lower melting point, such as, less than about 125° C., less than about 120° C., less than about 115° C., less than about 110° C. or lower.

c. Aggregating Factor

An aggregating factor or flocculant may be an inorganic cationic coagulant, such as, for example, polyaluminum chloride (PAC), polyaluminum sulfosilicate (PASS), aluminum sulfate, zinc sulfate, magnesium sulfate, chlorides of magnesium, calcium, zinc, beryllium, aluminum, sodium, other metal halides including monovalent and divalent halides.

The aggregating factor may be present in an emulsion in an amount of from, for example, from about 0 to about 10 wt %, from about 0.05 to about 5 wt % based on the total solids in the toner.

The aggregating factor may also contain minor amounts of other components, for example, nitric acid.

d. Stabilizer

A bio-based stabilizer is introduced before, during or after aggregation is complete to contribute to terminating particle aggregation and growth. The bio-based stabilizer comprises, for example, a polyol, as taught herein or as known in the art, or a polyhydroxylated organic acid or acid salt, such as, an aldopentose, an aldohexose and so on. The stabilizers of interest do not chelate, for example, metal ion. Hence, to control gloss, other reagents or tools are used to control, for example, metal ion content of a toner.

Suitable polyols may be selected from, for example, sugars, saccharides, oligosaccharides, polysaccharides, polyhydroxyacids and sugar alcohols, and portions of such polymers. Examples include, adonitol, arabitol, sorbitol, mannitol, galactose, galactitol, lactose, fructose, gluconic acid, lactobionic acid, isomaltose, inositol, lactitol, xylitol, maltitol, 1-methyl-glucopyranoside, 1-methyl-galactopyranoside, 1-methyl-mannopyranoside, erythritol, diglycerol, polyglycerol, sucrose, glucose, amylose, nystose, kestose, trehalose, raffinose, gentianose, combinations thereof and the like. Also, glycogen, a starch, a cellulose, a demineralized or unmodified chitin, a dextrin, a gelatin, a dextrose or other such polysaccharides, or fractions thereof, can be used. Those compounds generally are commercially available or can be obtained from natural sources, such as, crustacean shells, plants and so on, practicing known methods.

Suitable organic acids include, for example carboxylic acids, dicarboxylic acids and the like, that can carry any number of backbone carbon residues, such as, for example, 4 or more carbons, 5 or more carbons, 6 or more carbons, or more. Suitable such carboxylic acids include, for example, aldopentoses, aldohexoses, aldoheptoses and so on, and salts thereof, such as, citric acid, oxalic acid, benzoic acid, glucuronic acid, mellitic acid, tartaric acid, isomers thereof and the like. Hence, an example is gluconic acid or any derivatives thereof which include but are not limited to gluconic acid, glucono-δ-lactone, sodium gluconate, calcium gluconate and potassium gluconate.

The stabilizer is added to an emulsion in amounts from at least about 1 part per hundred (pph) based on the solids weight in the emulsion, at least about 2 pph, at least about 3 pph, at least 4 pph, at least about 5 pph, or more.

e. Surface Additive

In embodiments, the toner particles can be mixed with one or more of silicon dioxide or silica ($SiO_2$), titania or titanium dioxide ($TiO_2$) and/or cerium oxide. Silica may be a first silica and a second silica. The first silica may have an average primary particle size, measured in diameter, from about 5 nm to about 50 nm, from about 5 nm to about 25 nm, from about 20 nm to about 40 nm. The second silica may have an average primary particle size, measured in diameter, from about 100 nm to about 200 nm, from about 100 nm to about 150 nm, from about 125 nm to about 145 nm. The second silica may have a larger average size (diameter) than the first silica. The titania may have an average particle size in the range of from about 5 nm to about 50 nm, from about 5 nm to about 20 nm, from about 10 nm to about 50 nm. The cerium oxide may have an average primary particle size in the range of from about 5 nm to about 50 nm, from about 5 nm to about 20 nm, from about 10 nm to about 50 nm.

Zinc stearate also may be used as an external additive. Calcium stearate and magnesium stearate may provide similar functions. Zinc stearate may have an average primary particle size from about 500 nm to about 700 nm, from about 500 nm to about 600 nm, from about 550 nm to about 650 nm.

f. Carrier

Carrier particles include those that are capable of triboelectrically obtaining a charge of polarity opposite to that of the toner particles. Examples of suitable carrier particles include granular zircon, granular silicon, glass, steel, nickel, ferrites, iron ferrites, silicon dioxide, nickel berry carriers as disclosed in U.S. Pat. No. 3,847,604, the entire disclosure of which is hereby incorporated herein by reference, comprised of nodular carrier beads of nickel, characterized by surfaces of reoccurring recesses and protrusions thereby providing particles with a relatively large external area, those disclosed in U.S. Pat. Nos. 4,937,166 and 4,935,326, the disclosure of each of which hereby is incorporated herein by reference, and so on. The carrier particles may have an average particle size of from about 20 to about 85 μm, from about 30 to about 60 μm, from about 35 to about 50 μm.

g. Shells

In embodiments, an optional shell may be applied to the formed toner particles, aggregates or coalesced particles. Any polymer, including those described above as suitable for the core, may be used for the shell. The shell polymer may be applied to the particles or aggregates by any method within the purview of those skilled in the art.

An amorphous polyester resin may be used to form a shell over the particles or aggregates to form toner particles or aggregates having a core-shell configuration. An LMW amorphous polyester resin may be used to form a shell over the particles or aggregates.

The shell polymer may be present in an amount of from about 1% to about 60% by weight of the toner particles or aggregates, from about 10% to about 50% by weight of the toner particles or aggregates.

B. Toner Particle Preparation

1. Method a. Particle Formation

The toner particles may be prepared by any method within the purview of one skilled in the art, for example, any of the emulsion/aggregation (EA) methods can be used with the polyester resin. However, any suitable method of preparing toner particles may be used, including chemical processes, such as, suspension and encapsulation processes disclosed, for example, in U.S. Pat. Nos. 5,290,654 and 5,302,486, the disclosure of each of which hereby is incorporated by reference in entirety; by conventional granulation methods, such as, jet milling; pelletizing slabs of material; other mechanical processes; any process for producing nanoparticles or microparticles; and so on.

In embodiments relating to an emulsification/aggregation process, a resin can be dissolved in a solvent, and can be mixed into an emulsion medium, for example water, such as, deionized water, and optionally a surfactant.

Following emulsification, toner compositions may be prepared by aggregating a mixture or slurry of one or more resins, such as, an amorphous resin, an optional wax, an optional flocculant, an optional colorant and any other desired additives in an emulsion or slurry, optionally, with surfactants as described above, and then optionally coalescing the aggregate mixture. A mixture may be prepared by adding an optional colorant, which may be a mixture of two or more emulsions containing the requisite reagents.

Additionally, in embodiments, the mixture may be homogenized with mixing of from about 600 to about 4,000 rpm. Homogenization may be by any suitable means, including, for example, an IKA ULTRA TURRAX T50 probe homogenizer.

b. Aggregation

Following preparation of the above mixture or slurry comprising at least one resin, such as, an amorphous resin, an optional wax, an optional colorant, an optional flocculant and other reagents, often, it is desirable to form larger particles or aggregates, often sized in micrometers, of the smaller particles from the initial polymerization reaction, often sized in nanometers. An aggregating factor may be added to the mixture. Suitable aggregating factors include, for example, aqueous solutions of a divalent cation, a multivalent cation or a compound comprising same.

The aggregating factor, as provided above, may be, for example, a polyaluminum halide, such as, polyaluminum chloride (PAC) or the corresponding bromide, fluoride or iodide; a polyaluminum silicate, such as, polyaluminum sulfosilicate (PASS); or a water soluble metal salt, including, aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate or combinations thereof.

In embodiments, the aggregating factor may be added to the mixture at a temperature that is below the glass transition temperature ($T_g$) of the resin or of a polymer.

The aggregating factor may be added to the mixture components to form a toner in an amount of, for example, from about 0.1 pph to about 5 pph, from about 0.2 pph to about 2 pph of the reaction mixture.

To control aggregation of the particles, the aggregating factor may be metered into the mixture over time. For example, the factor may be added incrementally into the mixture over a period of from about 5 to about 240 minutes, from about 30 to about 200 minutes.

Addition of the aggregating factor may be done while the mixture is homogenized with mixing from about 600 to about 4,000 rpm. Homogenization may be by any suitable means, including, for example, an IKA ULTRA TURRAX T50 probe homogenizer, and at a temperature that is below the $T_g$ of the resin or polymer, from about 0° C. to about 60° C., from about 1° C. to about 50° C. The growth and shaping of the particles following addition of the aggregation factor may be accomplished under any suitable condition(s).

Addition of the aggregating factor also may be done while the mixture is maintained under stirred conditions, in embodiments, from about 50 rpm to about 1,000 rpm, from about 100 rpm to about 500 rpm.

The pH of the emulsion can vary from about 3 to about 9, from about 4 to about 8, as a design choice.

The particles may be permitted to aggregate until a predetermined desired particle size is obtained. Particle size can be monitored during the growth process. For example, samples may be taken during the growth process and analyzed, for example, with a COULTER COUNTER, for average particle size. The aggregation thus may proceed by maintaining the mixture, for example, at elevated temperature, or slowly raising the temperature, for example, from about 40° C. to about 100° C., and holding the mixture at that temperature for from about 0.5 hours to about 6 hours, from about hour 1 to about 5 hours, while maintaining stirring, to provide the desired aggregated particles. Once the predetermined desired particle size is attained, the growth process is halted. A stabilizer of interest is added to the emulsion before or when the desired particle size is obtained.

Once the desired final size of the toner particles or aggregates is achieved, the pH of the mixture may be adjusted with base to a value of from about 6 to about 12, from about 6 to about 10. The adjustment of pH may be used to freeze, that is, to stop, toner particle growth. The base used to stop toner particle growth may be, for example, an alkali metal hydroxide, such as, for example, sodium hydroxide, potassium hydroxide, ammonium hydroxide, combinations thereof and the like. A stabilizer of interest is added to assist adjusting the pH to the desired value. The base may be added in amounts from about 2 to about 25% by weight of the mixture, from about 4 to about 10% by weight of the mixture.

The characteristics of the toner particles may be determined by any suitable technique and apparatus. Volume average particle diameter and geometric standard deviation may be measured using an instrument, such as, a Beckman Coulter MULTISIZER 3, operated in accordance with the instructions of the manufacturer.

The aggregated particles may be of a size of less than about 5.5 μm, from about 4.0 μm to about 5.0 μm, from about 4.5 μm to about 5.0 μm.

In embodiments, after aggregation, but prior to coalescence, a resin coating may be applied to the aggregated particles to form a shell thereover. Any resin described herein or as known in the art may be used as the shell.

c. Coalescence

Following aggregation to a desired particle size and application of any optional shell, the particles then may be coalesced to a desired final shape, such as, a circular shape, to correct for irregularities in shape and size, the coalescence being achieved by, for example, heating the mixture to a temperature from about 30° C. to about 100° C., from about 40° C. to about 80° C., which may be at or above the $T_g$ of the resins used to form the toner particles, and/or reducing the stirring, for example to from about 1000 rpm to about 100 rpm, from about 800 rpm to about 200 rpm. Coalescence may be conducted over a period from about 0.01 to about 9 hours, from about 0.1 to about 4 hours, see, for example, U.S. Pat. No. 7,736,831.

After aggregation and/or coalescence, the mixture may be cooled to room temperature (RT), such as, from about 20° C. to about 25° C. The cooling may be rapid or slow, as desired. A suitable cooling method may include introducing cold water to a jacket around the reactor or discharging toner into cold water. After cooling, the toner particles optionally may be washed with water and then dried. Drying may be by any suitable method, including, for example, freeze-drying.

Optionally, a coalescing agent can be used. Examples include, but are not limited to, benzoic acid alkyl esters, ester alcohols, glycol/ether-type solvents, long chain aliphatic alcohols, aromatic alcohols, mixtures thereof and the like. Examples of benzoic acid alkyl esters include those where the alkyl group, which can be straight or branched, substituted or unsubstituted, has from about 2 to about 30 carbon atoms, such as decyl or isodecyl benzoate, nonyl or isononyl benzoate, octyl or isooctyl benzoate, 2-ethylhexyl benzoate, tridecyl or isotridecyl benzoate, 3,7-dimethyloctyl benzoate, 3,5,5-trimethylhexyl benzoate, mixtures thereof and the like. Examples of such benzoic acid alkyl esters include VELTA® 262 (isodecyl benzoate) and VELTA® 368 (2-ethylhexyl benzoate) available from Velsicol Chemical Corp. Examples of ester alcohols include hydroxyalkyl esters of alkanoic acids, where the alkyl group, which can be straight or branched, substituted or unsubstituted, and can have from about 2 to about 30 carbon atoms, such as, 2,2,4-trimethylpentane-1,3-diol monoisobutyrate. An example of an ester alcohol is TEXANOL® (2,2,4-trimethylpentane-1,3-diol monoisobutyrate) available from Eastman Chemical Co. Examples of glycol/ether-type solvents include diethylene glycol monomethylether acetate, diethylene glycol monobutylether acetate, butyl carbitol acetate (BCA) and the like. Examples of long chain aliphatic alcohols include those where the alkyl group is from about 5 to about 20 carbon atoms, such as, ethylhexanol, octanol, dodecanol and the like. Examples of aromatic alcohols include benzyl alcohol and the like.

In embodiments, the coalescence agent (or coalescing agent or coalescence aid agent) evaporates during later stages of the emulsion/aggregation process, such as, during a second heating step, that is, generally above the $T_g$ of the resin or a polymer. The final toner particles are thus, free of, or essentially or substantially free of any remaining coalescence agent. To the extent that any remaining coalescence agent may be present in a final toner particle, the amount of remaining coalescence agent is such that presence thereof does not impact negatively any properties or the performance of the toner or developer.

The coalescence agent can be added prior to the coalescence or fusing step in any desired or suitable amount. For example, the coalescence agent can be added in an amount of from about 0.01 to about 10% by weight, based on the solids content in the reaction medium, from about 0.05, from about 0.1%, to about 0.5, to about 3.0% by weight, based on the solids content in the reaction medium. Of course, amounts outside those ranges can be used, as desired.

In embodiments, the coalescence agent can be added at any time between aggregation and coalescence. The coalescence agent may be added after aggregation is, "frozen," or completed.

Coalescence may proceed and be accomplished over a period of from about 0.1 to about 9 hours, from about 0.5 to about 4 hours.

e. Optional Additives

In embodiments, the toner particles also may contain other optional additives.

i. Charge Additives

The toner may include any known charge additives in amounts of from about 0.1 to about 10 weight %, from about 0.5 to about 7 weight % of the toner. Examples of such charge additives include alkyl pyridinium halides, bisulfates, the charge control additives of U.S. Pat. Nos. 3,944,493; 4,007,293; 4,079,014; 4,394,430; and 4,560,635, the disclosure of each of which hereby is incorporated by reference in entirety, negative charge enhancing additives, such as, aluminum complexes, and the like.

Charge enhancing molecules can be used to impart either a positive or a negative charge on a toner particle. Examples include quaternary ammonium compounds, see, for example, U.S. Pat. No. 4,298,672, organic sulfate and sulfonate compounds, see for example, U.S. Pat. No. 4,338,390, cetyl pyridinium tetrafluoroborates, distearyl dimethyl ammonium methyl sulfate, aluminum salts and so on.

Such enhancing molecules can be present in an amount of from about 0.1 to about 10% or from about 1 to about 3% by weight.

ii. Surface Modifications

Surface additives can be added to the toner compositions of the present disclosure, for example, after washing or drying. Examples of such surface additives include, for example, one or more of a metal salt, a metal salt of a fatty acid, a colloidal silica, a metal oxide, such as, $TiO_2$ (for example, for improved RH stability, tribo control and improved development and transfer stability), an aluminum oxide, a cerium oxide, a strontium titanate, $SiO_2$, mixtures thereof and the like. Examples of such additives include those disclosed in U.S. Pat. Nos. 3,590,000; 3,720,617; 3,655,374; and 3,983,045, the disclosure of each of which is hereby incorporated by reference in entirety.

Surface additives may be used in an amount of from about 0.1 to about 10 wt %, from about 0.5 to about 7 wt % of the toner.

Other surface additives include lubricants, such as, a metal salt of a fatty acid (e.g., zinc or calcium stearate) or long chain alcohols, such as, UNILIN 700 available from Baker Petrolite and AEROSIL R972® available from Degussa. The coated silicas of U.S. Pat. Nos. 6,190,815 and 6,004,714, the disclosure of each of which hereby is incorporated by reference in entirety, also can be present. The additive can be present in an amount of from about 0.05 to about 5%, from about 0.1 to about 2% of the toner, which additives can be added during the aggregation or blended into the formed toner product.

Toners of the instant disclosure also may possess a parent toner charge per mass ratio (q/m) of from about −5 μC/g to about −90 μC/g, and a final toner charge after surface additive blending of from about −15 μC/g to about −80 μC/g.

The dry toner particles, exclusive of external surface additives, may have the following characteristics: (1) volume average diameter (also referred to as "volume average particle diameter") of from about 2.5 to about 20 μm, from about 2.75 to about 10 μm, from about 3 to about 7.5 μm; (2) number average geometric standard deviation ($GSD_n$) and/or volume average geometric standard deviation ($GSD_v$) of less than about 1.25, less than about 1.2, less than about 1.15, less than about 1.1; and (3) circularity of from about 0.9 to about 1.0 (measured with, for example, a Sysmex FPIA 2100 analyzer), from about 0.94 to about 0.985, from about 0.95 to about 0.97.

II. Developers

A. Composition

The toner particles thus formed may be formulated into a two part developer composition. For example, the toner particles may be mixed with carrier particles to achieve a two component developer composition. The toner concentration in the developer may be from about 1% to about 25%, from about 2% to about 15% by weight of the total weight of the developer, with the remainder of the developer composition being the carrier. However, different toner and carrier percentages may be used to achieve a developer composition with desired characteristics.

1. Carrier

Examples of carrier particles for mixing with the toner particles include those particles that are capable of triboelectrically obtaining a charge of polarity opposite to that of the toner particles. Examples of suitable carrier particles include granular zircon, granular silicon, glass, steel, nickel, ferrites, iron ferrites, silicon dioxide, one or more polymers and the like. Other carriers include those disclosed in U.S. Pat. Nos. 3,847,604; 4,937,166; and 4,935,326.

The carrier particles may include a core with a coating thereover, which may be formed from a polymer or a mixture of polymers that are not in close proximity thereto in the triboelectric series, such as, those as taught herein or as known in the art. The coating may include fluoropolymers, such as polyvinylidene fluorides, polymers or copolymers of acrylates and methacryrates, terpolymers of styrene, methyl methacrylates, silanes, such as triethoxy silanes, tetrafluoroethylenes, other known coatings and the like. The coating may have a coating weight of from about 0.1 to about 5% by weight of the carrier, from about 0.5 to about 2% by weight of the carrier.

The carrier particles may be prepared by mixing the carrier core with polymer in an amount from about 0.05 to about 10% by weight, from about 0.01 to about 3% by weight, based on the weight of the coated carrier particle, until adherence thereof to the carrier core is obtained, for example, by mechanical impaction and/or electrostatic attraction.

Suitable carriers may include a steel core, for example, of from about 25 to about 100 μm in size, from about 50 to about 75 μm in size, coated with about 0.5% to about 10% by weight, from about 0.7% to about 5% by weight of a polymer mixture including, for example, methylacrylate and carbon black, using the process described, for example, in U.S. Pat. Nos. 5,236,629 and 5,330,874.

III. Devices Comprising a Toner Particle

Toners and developers can be combined with a number of devices ranging from enclosures or vessels, such as, a vial, a bottle, a flexible container, such as a bag or a package, and so on, to devices that serve more than a storage function.

A. Imaging Device Components

The toner compositions and developers of interest can be incorporated into devices dedicated, for example, to delivering same for a purpose, such as, forming an image. Hence, particularized toner delivery devices are known, see, for example, U.S. Pat. No. 7,822,370, and can contain a toner preparation or developer of interest. Such devices include cartridges, tanks, reservoirs and the like, and can be replaceable, disposable or reusable. Such a device can comprise a storage portion; a dispensing or delivery portion; and so on; along with various ports or openings to enable toner or developer addition to and removal from the device; an optional portion for monitoring amount of toner or developer in the device; formed or shaped portions to enable siting and seating of the device in, for example, an imaging device; and so on.

B. Toner or Developer Delivery Device

A toner or developer of interest may be included in a device dedicated to delivery thereof, for example, for recharging or refilling toner or developer in an imaging device component, such as, a cartridge, in need of toner or developer, see, for example, U.S. Pat. No. 7,817,944, wherein the imaging device component may be replaceable or reusable.

IV. Imaging Devices

The toners or developers can be used for electrostatographic or electrophotographic processes, including those disclosed in U.S. Pat. No. 4,295,990, the disclosure of which hereby is incorporated by reference in entirety. In embodiments, any known type of image development system may be used in an image developing device, including, for example, magnetic brush development, jumping single component development, hybrid scavengeless development (HSD) and the like. Those and similar development systems are within the purview of those skilled in the art.

Color printers commonly use four housings carrying different colors to generate full color images based on black plus the standard printing colors, cyan, magenta and yellow. However, in embodiments, additional housings may be desirable, including image generating devices possessing five housings, six housings or more, thereby providing the ability to carry additional toner colors to print an extended range of colors (extended gamut).

The following Examples illustrate embodiments of the instant disclosure. The Examples are intended to be illustrative only and are not intended to limit the scope of the present disclosure. Parts and percentages are by weight unless otherwise indicated.

EXAMPLES

Comparative Example 1

No Chelating Agent or Gel Latex

Into a 2 liter glass reactor equipped with an overhead mixer were added 85.44 g LMW amorphous resin ($M_w$=19,400, $T_g$ onset=60° C., 35% solids) emulsion (36.4 wt %), 88.05 g HMW amorphous resin ($M_w$=86,000, $T_g$ onset=56° C., 35% solids) emulsion (35.25 wt %), 23.64 g crystalline resin ($M_w$=23,300, $M_n$=10,500, Tm=71° C., 35% solids) emulsion (35.17 wt %), 36.99 g IGI wax dispersion (29.93 wt %) and 41.80 g cyan pigment PB15:3 (17.21 wt %). Separately 2.15 g $Al_2(SO_4)_3$ (27.85 wt %) were added as flocculent under homogenization. The mixture was heated to 38.5° C. to aggregate the particles while stirring at 200 rpm. The particle size was monitored with a COULTER COUNTER until the core particles reached a volume average particle size of 5.42 μm with a geometric size distribution (GSD) volume ($GSD_v$) of 1.21, GSD number $GSD_n$) of 1.27, and then a mixture of 47.17 g and 48.62 g of above mentioned LMW and HMW resin emulsions were added as shell material, resulting in a core-shell structured particles with an average particle size of 5.83 μm, $GSD_v$ of 1.20, $GSD_n$ of 1.25. Thereafter, the pH of the reaction slurry was then increased to 9.24 using 4 wt % NaOH solution to freeze the toner growth. After freezing, the reaction mixture was heated to 85° C. while maintaining pH greater than 8.2. Toner particles have average particle size of 6.34 μm, $GSD_v$ of 1.21, $GSD_n$ of 1.29. After being kept at 85° C. for about 30 min, pH was reduced to 7.6 stepwise over 44 min using pH 5.7 acetic acid/sodium acetate (HAc/NaAc) buffer solution for coalescence. The toner was quenched after coalescence, resulting in a final particle size of 7.34 μm, $GSD_v$ of 1.31, $GSD_n$ of 1.39. The toner slurry was then cooled to room temperature, separated by sieving (25 μm), filtration, followed by washing and freeze dried.

The final particle size was large and the size distribution was broad. Without chelating agent, the particles adhere when pH was reduced for coalescence.

Comparative Example 2

No Chelating Agent and 11.0 pph Gel Latex

The materials and methods of Comparative Example 1 were practiced except that 44.35 g of a styrene gel latex (24.81 wt %) were introduced with a reduction in amount of the other reactants, 83.36 g of the LMW emulsion (37 wt %), 78.55 g of the HMW emulsion (38.5 wt %), 27.28 g of the crystalline resin emulsion (35.60 wt %), 42.53 g of IGI wax dispersion (30.37 wt %) and 48.77 g cyan pigment PB15:3 (17.21 wt %). The mixture was heated to 39° C. with stirring at 380 rpm. When the particles reached 4.63 μm in size with a $GSD_v$ of 1.25, a mixture of 54.03 g and 50.91 g of the amorphous resin emulsions were added as shell material, resulting in core-shell structured particles with an average particle size of 6.02 μm, $GSD_v$ of 1.20. After freezing, the reaction mixture was heated to 95° C., the pH was reduced to 6.35 using the pH 5.7 HAc/NaAc buffer solution, which was added over about 31 minutes at 95° C., using a feeding pump for coalescence. The final particle size was 6.15 μm, $GSD_v$ of 1.24 and circularity of 0.969.

Example 1

0.86 pph Sodium Gluconate without Chelator or Gel Latex

Essentially the same materials and methods of Comparative Example 1 were used, with minor modifications. To the reactor were added 101.77 g of LMW emulsion (34.88 wt %), 104.35 g of HMW emulsion (34.02 wt %), 27.22 g of crystalline emulsion (34.9 wt %), 42.21 g of IGI wax dispersion (29.93 wt %) and 48.77 g of cyan pigment PB15:3 (15.8 wt %). Aggregation was at 40° C. at 250 rpm. The particle size was 5.04 μm with a $GSD_v$ of 1.21, $GSD_n$ of 1.22, when a mixture of 56.19 g and 57.61 g of the amorphous resins were added as shell material, resulting in core-shell structured particles with an average particle size of 5.65 μm, $GSD_v$ of 1.20, and $GSD_n$ of 1.22. Thereafter, the pH of the reaction slurry was then increased to 4.0 using 4 wt % NaOH solution followed by 12.0 g sodium gluconate. After freezing, the reaction mixture was heated to 85° C. while maintaining pH greater than 7.8. Toner particles had an average particle size of 5.65 μm, $GSD_v$ of 1.19, $GSD_n$ of 1.19. After being kept at 85° C. for about 10 min, pH was reduced to 7.0 stepwise over 80 min using the pH 5.7 HAc/NaAc buffer. The toner was quenched after coalescence, resulting in a final particle size of 6.14 μm, $GSD_v$ of 1.21, $GSD_n$ of 1.22. The circularity of final particle was 0.963. Hence, highly uniform populations of small-sized particles were obtained without the use of a chemical chelator or gel latex.

Example 2

3.43 pph Sodium Gluconate Without EDTA or Gel Latex

The same materials and methods of Example 1 were practiced. When the particles reached 4.58 μm with a $GSD_v$ of 1.22, the shell resins were added to yield particles of 6.61 μm, $GSD_v$ of 1.21, $GSD_n$ of 1.27. Following aggregation and coalescence, the $GSD_v$ was 1.22 and the circularity was 0.949. Again, a uniform population of particles was obtained without the need for a chemical chelator or a gel latex.

Example 3

The residual bulk aluminum content of the two experimental toners (Examples 1 and 2) and the two control toners (Comparative Examples 1 and 2) was determined by ICP MS practicing known materials and methods.

The aluminum ion content of the two control toners (Comparative Example 1 was theoretical and Comparative Example 2 was actual) was substantially the same as that of the two experimental toners made without chemical chelating agent or gel latex. Hence, toner with higher levels of aluminum can be produced as smaller particles of tight distribution. The toner of Comparative Example 2 contains gel latex. Thus, it can be expected that toner will have higher and unacceptable crease fix MFT, which is incompatible with lower melting toner.

Example 4

The toner of Example 2 was submitted for fusing evaluation to determine the initial fusing performance for a toner using sodium gluconate as stabilizer without a chelating agent or gel latex.

Fusing performance (gloss, crease and hot offset) of particles was collected with the samples fused onto Color Xpressions+ paper (90 prints per min) using a commercially available fusing fixture. The cyan toner of Example 2 produced low gloss prints. Gloss was comparable to that of sample toners made with no EDTA. The crease fix MFT for the sample was equivalent to commercially available toner. There were no signs of gloss mottle or hot offset with the prints using the cyan toner of Example 2.

Example 5

The cyan toner of Example 2 was submitted for charging evaluation. Good bench charging performance was observed comparable to that of a commercially available toner made using standard processes, such as, made with a chelating agent and/or with gel latex.

It will be appreciated that various features of the above-disclosed and other features and functions, or alternatives thereof, may be desirably combined into many other different systems or applications. Also various presently unforeseen or unanticipated alternatives, modifications, variations or improvements therein may be subsequently made by those skilled in the art, which are also intended to be encompassed by the following claims. Unless specifically recited in a claim, steps or components of claims should not be implied or imported from the specification or any other claims as to any particular order, number, position, size, shape, angle, color or material.

All references cited herein are herein incorporated by reference in entirety.

We claim:

1. A slurry comprising at least one resin, a flocculant comprising a metal ion, an optional wax, an optional colorant, an optional gel latex and a bio-based stabilizer that is not a chelator of metal ions, wherein the slurry does not comprise a chemical chelating agent.

2. The slurry of claim 1, wherein said stabilizer is used in an amount of at least about 1 part per hundred (pph).

3. The slurry of claim 1, wherein said stabilizer comprises a polyhydroxylated organic acid or salt thereof.

4. The slurry of claim 3, wherein said organic acid comprises a gluconic acid.

5. The slurry of claim 3, wherein said organic acid salt comprises a sodium gluconate.

6. The slurry of claim 1, wherein said stabilizer is selected from the group consisting of gluconic acid, sodium gluconate, glucono-δ-lactone, calcium gluconate and potassium gluconate.

7. The slurry of claim 1, further comprising a gel latex.

* * * * *